US009295311B2

(12) United States Patent
Gadzinski et al.

(10) Patent No.: US 9,295,311 B2
(45) Date of Patent: Mar. 29, 2016

(54) LUGGAGE SUPPORT SYSTEM

(71) Applicants: Norman Gadzinski, Hudson, MI (US); Gina Provenzano, Alma, MI (US)

(72) Inventors: Norman Gadzinski, Hudson, MI (US); Gina Provenzano, Alma, MI (US)

( * ) Notice: Subject to any disclaimer, the term of this patent is extended or adjusted under 35 U.S.C. 154(b) by 0 days.

(21) Appl. No.: 14/267,234

(22) Filed: May 1, 2014

(65) Prior Publication Data

US 2015/0313334 A1 Nov. 5, 2015

(51) Int. Cl.

| | |
|---|---|
| ***A45C 9/00*** | (2006.01) |
| ***A45C 5/14*** | (2006.01) |
| ***A45C 13/26*** | (2006.01) |

(52) U.S. Cl.

CPC . *A45C 9/00* (2013.01); *A45C 5/146* (2013.01); *A45C 13/262* (2013.01); *A45C 2013/267* (2013.01)

(58) Field of Classification Search

CPC ..... A45C 9/00; A45C 2009/007; A45C 2013/267; A45C 13/262; A45C 13/26; A45C 2200/015; A45C 5/146

USPC ..... 190/1, 11, 12 A, 115, 15.1, 18 R, 18 A; 108/25, 125

See application file for complete search history.

(56) References Cited

U.S. PATENT DOCUMENTS

| | | | | |
|---|---|---|---|---|
| 445,400 | A * | 1/1891 | Hayes | 190/13 R |
| 1,616,632 | A * | 2/1927 | Mastrontonio | 280/79.2 |
| 2,729,460 | A * | 1/1956 | Forman | 280/40 |
| 3,865,392 | A | 2/1975 | Hartway | |
| 4,036,336 | A | 7/1977 | Burtley | |
| 5,184,477 | A * | 2/1993 | Brown et al. | 62/457.7 |
| 5,323,887 | A * | 6/1994 | Scicluna et al. | 190/18 A |
| 5,497,865 | A * | 3/1996 | Yun-Pi | 190/115 |
| 5,680,914 | A * | 10/1997 | Reiser | 190/11 |
| 6,575,274 | B1 * | 6/2003 | Huang | 190/115 |
| 7,266,073 | B2 * | 9/2007 | Ishibashi et al. | 369/120 |
| 8,540,063 | B2 | 9/2013 | Latowsky | |
| 2002/0017766 | A1 * | 2/2002 | Thompson | 280/30 |
| 2004/0226791 | A1 * | 11/2004 | Levy | 190/11 |
| 2011/0108381 | A1 * | 5/2011 | Gibson | 190/11 |
| 2012/0325607 | A1 * | 12/2012 | Webster et al. | 190/115 |

FOREIGN PATENT DOCUMENTS

| | | | |
|---|---|---|---|
| FR | 2760178 | A1 * | 9/1998 |
| GB | 2498761 | A * | 7/2013 |

* cited by examiner

*Primary Examiner* — Sue A Weaver

(74) *Attorney, Agent, or Firm* — Vincent G. LoTempio; Kloss, Stenger & LoTempio; David Stephenson

(57) ABSTRACT

A luggage support system converts between a luggage position and a support position through manipulation of a handle portion and a mobile portion on a luggage. The handle portion and the mobile portion are integrated into the luggage for standard operational functions. The luggage position can carry and store standard items for which luggage is generally designed. The support position forms a support stand for the luggage. The luggage can operate from the support position. The luggage converts between the support position and the luggage position through a series of extension and pivoting manipulations. Both the handle and the mobile portions include legs that extend and retract from inside the luggage to move between positions. The legs extend fully and pivot towards each other up to 90 degrees to form the support position. The legs pivot retract along the surface of the luggage to return to the luggage position.

9 Claims, 6 Drawing Sheets

LUGGAGE SUPPORT SYSTEM

FIELD OF THE INVENTION

The present invention relates generally to a luggage support system. More so, the luggage support system converts an extendable handle and wheels found in luggage into a support stand.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

By way of educational background, another aspect of the prior art generally useful to be aware of is that luggage can include any number of bags, cases, and containers used to hold a plurality of articles during travel, business, and also for general purposes. The different types of luggage can include a trunk, a suitcase, a hand carry-on baggage, a tote bag, and a duffel bag. Often, luggage includes small wheels on a longitudinal lower edge of the luggage that enable rolling the luggage on a surface, and a handle on an opposite end of the wheels to grip the luggage.

It is known that of all such varieties of luggage, there is a well-known class of wheeled luggage, which typically includes at least two wheels that may be used to roll the luggage along the ground. These wheels are oriented so that the luggage is rolled broadside. The wheels axe often of spinner wheels, swivelable caster style wheels, or a fixed, in-line skate style wheel. These types of luggage further include an extendable handle with which the user balances the case on these two wheels. The handle can be used to tilt the luggage from an upright position onto its wheels, and to provide a convenient handle by which to pull the bag along as it rolls on its wheels.

Typically, conventional wheeled luggage can be difficult to transport more than one piece of luggage simultaneously. For example, it is difficult to transport three or more wheeled pieces of luggage with only two hands. Further, it is difficult to transport one wheeled luggage while carrying another, non-wheeled bag.

The handles and wheels on the luggage often engage a ground surface, especially while the luggage is resting on the ground. The handle can include a sliding guide rail that extends and retracts from the interior of the luggage. The handle can extend out and help balance the luggage, or provide extra length for reaching a hand during transport. The wheels, while usually fixed on the edge of the luggage, can also form a pivot point for balancing the luggage on the ground during transport.

Even though the above cited methods for a luggage support system address some of the needs of the market, a luggage that converts between a luggage position and a support position through manipulation of the handle and the wheels is still desired.

SUMMARY OF THE INVENTION

The present invention is directed to a luggage support system that converts operational components of luggage into a stable and mobile support stand. The luggage support system utilizes a handle portion and a mobile portion that are integrated into the luggage to enable conversion between a luggage position and a support position. The luggage position provides standard item carrying and storing capacities for which luggage is general designed. The support position forms a support stand for the luggage and any number of items stored in the luggage. The luggage support system converts between the support position and the luggage position through a series of extension and pivoting manipulations. The luggage can be mobile or stationary from either the luggage position or the support position. It is significant to note that the luggage in not intended to be moved once converted into the support position. However, the luggage could be moved through pushing or pulling by a handle end.

In one embodiment, the present invention covers a luggage support system having an integrally connected handle portion that longitudinally extends from an upper end of the luggage, and an integrally connected mobile portion that longitudinally extends from a lower end of the luggage. The handle portion and the mobile portion are generally operable from opposite ends of the luggage. The handle portion may include a substantially U-shaped grip configured to provide a surface for manipulating the luggage. The handle portion may also include a handle leg that extend and retract into the interior conversion section of the luggage. The handle leg may telescopically extend and retract. The mobile portion may include a pair of caster wheels that extend from the opposite end of the luggage configured to roll on a ground surface. The mobile portion may include a mobile leg that extends into the interior conversion section of the luggage.

The interior conversion section comprises a frame that is physically separated from an interior storage section of the luggage. The interior storage section forms a cavity for standard luggage functions, such as storing items. The interior conversion section is physically separated from the interior storage section of the luggage with a barrier. The barrier separates the interior storage section from the interior conversion section; whereby the items in the storage section are restricted from contacting the mechanisms of the interior conversion section.

The interior conversion section comprises the mechanisms for converting between the luggage position and the support position. The handle leg and the mobile leg extend and retract from an interior conversion section of the luggage. The interior conversion section includes a handle channel for the handle leg to slidably engage. Likewise, the mobile leg slidably engages a pair of mobile channels in the interior conversion section. Each channel is fixed, with each leg moving relative to the respective channel. Each leg moves through a separate channel. The handle channel aligns at the same elevation as the pair of mobile channels.

From the luggage position, the handle portion and the mobile portion can extend longitudinally from opposite ends of the luggage, with each leg sliding into the respective channel. Once fully extended, the handle portion and the mobile portion may then pivot inwardly towards one another, about 90° to form a pair of support legs that make up the support position. The legs orient in a substantially perpendicular direction relative to a longitudinal axis of the luggage. In this manner, the support position is sufficiently strong to support the luggage and lightweight objects resting on the surface of the luggage.

The interior and storage sections of the luggage may be accessed and utilized from the support position. From the support position, the handle portion and the mobile portion can be rotated back 90°, and retracted back into the luggage to return to the luggage position. The conversion between luggage and support positions requires no tools and generally minimal physical exertion.

A first aspect of the present invention provides a luggage support system for converting a luggage into a luggage support, comprising:

a luggage comprising an interior storage section configured to contain at least one item;

the luggage further comprising an interior conversion section configured to at least partially convert the luggage between a luggage position and a support position, the interior conversion section comprising a handle channel and a pair of mobile channels, a handle portion disposed to position on an upper end of the luggage, the handle portion comprising a handle leg configured to slidably engage the handle channel between the luggage position and the support position, the luggage position comprising the handle leg fully retracted into the interior conversion section, the support position comprising the handle leg fully extended from the interior conversion section, and pivoted up to 90 degrees in a first direction relative to the luggage, a mobile portion disposed to position on a lower end of the luggage, the mobile portion comprising a mobile leg configured to slidably engage the pair of mobile channels between the luggage position and the support position, the luggage position further comprising the mobile leg fully retracted into the interior conversion section, the support position further comprising the mobile leg fully extended from the interior conversion section, and pivoted up to 90 degrees in the first direction relative to the luggage, wherein the handle portion and the mobile portion are configured to form a pair of substantially parallel support legs for supporting the luggage and at least one object in the support position, wherein the handle portion and the mobile portion are configured to perform a grip function and a mobile function in the luggage position.

In a second aspect of the present invention, the luggage comprises a spinner or caster luggage.

In another aspect, the at least one item in the interior storage section comprises clothes, toiletries, shoes, and paperwork.

In another aspect, the system comprises a barrier, the barrier configured to separate the interior storage section from the interior conversion section.

In another aspect, the interior conversion section comprises a handle channel, the handle channel configured to remain in a fixed position, the handle channel further configured to guide the handle leg in and out of the interior conversion section.

In another aspect, the interior conversion section comprises a pair of mobile channels, the pair of mobile channels configured to remain in a fixed position, the pair of mobile channels further configured to guide the mobile leg in and out of the interior conversion section.

In another aspect, the handle portion comprises a grip configured to enable gripping and manipulation of the luggage from the luggage position, the grip further configured to form a first support base for the support position.

In another aspect, the mobile portion comprises a pair of wheels configured to enable mobility by the luggage from the luggage position.

In another aspect, the handle leg comprises a handle leg channel end, the handle leg channel end configured to pivot up to 90 degrees on the handle channel.

In another aspect, the handle leg channel end comprises a first spring biased detent configured to lock the handle portion into the support position.

In another aspect, the mobile leg comprises a mobile leg channel end, the mobile leg channel end configured to pivot up to 90 degrees on the pair of mobile channels.

In another aspect, the mobile leg channel end comprises a second spring biased detent configured to lock the mobile portion into the support position.

In another aspect, the handle leg and the mobile leg comprises substantially the same length.

In another aspect, the luggage is configured to store and enable access of the at least one item from the luggage position and the support position.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which:

FIG. 1A illustrates the luggage support system in an exemplary luggage position, and FIG. 1B illustrates the luggage support system in an exemplary support position, in accordance with an embodiment of the present invention;

FIG. 2A illustrates an exterior view of an exemplary luggage, and FIG. 2B illustrates a detailed perspective view of an interior storage section in a luggage, in accordance with an embodiment of the present invention;

FIG. 4A illustrates the handle leg extending out along an exemplary handle channel and the mobile leg extending out along an exemplary pair of mobile channels, and FIG. 4B illustrates the handle leg and the mobile leg pivoting 90 degrees to form a support position, in accordance with an embodiment of the present invention;

FIG. 6A illustrates an exemplary linear plunger passing through an exemplary luggage lock hole to form a luggage position, FIG. 6B illustrates an exemplary linear plunger passing through an exemplary support lock hole to form a support position, FIG. 6C illustrates an exemplary center pivoting axle hole, a support lock hole, and a luggage lock hole, and FIG. 6D illustrates a linear plunger and a pivot rod, in accordance with an embodiment of the present invention.

Like reference numerals refer to like parts throughout the various views of the drawings.

DETAILED DESCRIPTION OF THE INVENTION

Figure 1A:
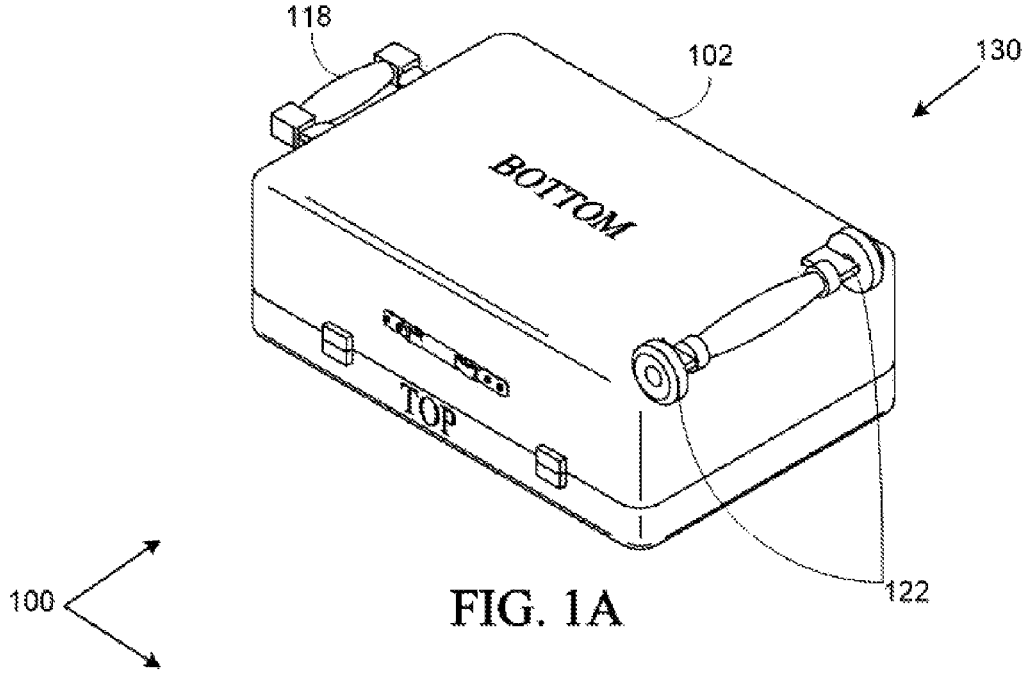
FIGS. 1A and 1B illustrate detailed perspective views of an exemplary luggage support system, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIGS. 1A and 1B. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1A-6D, a luggage support system 100 converts between a luggage position 130 and a support position 132 through manipulation of a handle portion 108 and a mobile portion 110 on a luggage 102. The handle portion 108 and the mobile portion 110 may be integrated into the luggage 102 for standard operational functions, and for enabling conversion between the luggage position 130 and the support position 132. The luggage position 130 is configured to carry and store standard items for which the luggage 102 is generally designed to hold. The support position 132 forms a support stand framework for the luggage 102 to stand. The luggage 102 may also be operable to open and close from the support position 132. The luggage support system 100 converts between the support position 132 and the luggage position 130 through a series of extension and pivoting manipulations. The luggage 102 can be mobile from the luggage position 130, and stationary from the support position 132.

Figure 1B:
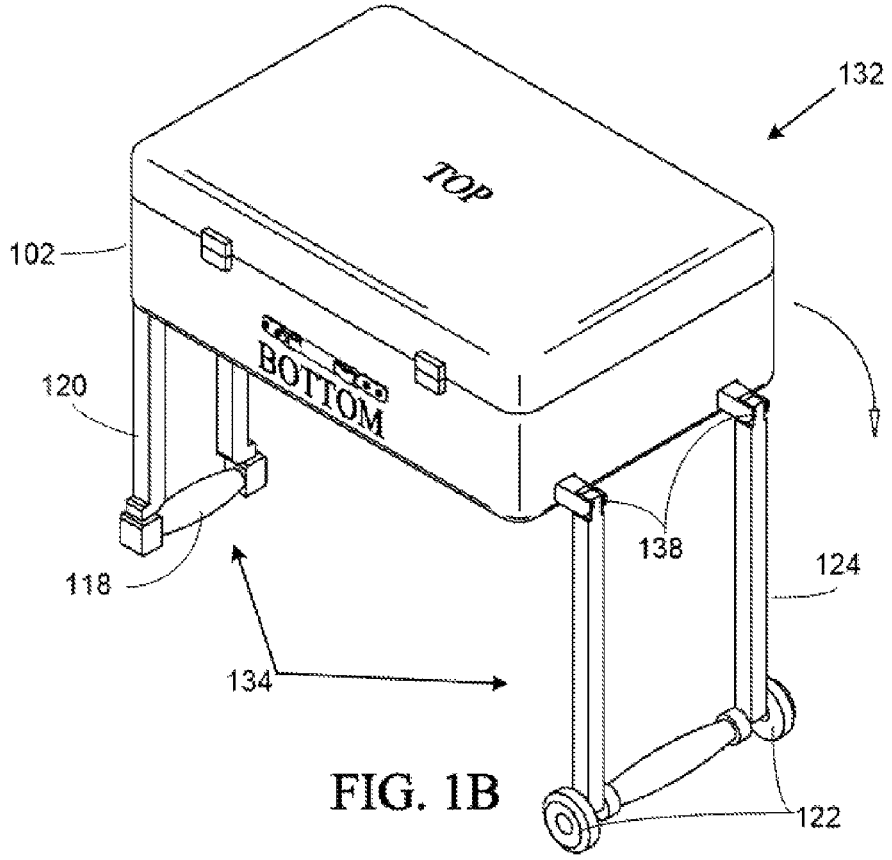

FIGS. 1A and 1B illustrate the luggage 102 converting between the luggage position 130 and the support position 132. The luggage 102 may include, without limitation, a spinner luggage, a caster luggage, a trunk, a suitcase, a hand carry-on baggage, a tote bag, and a duffel bag. However in other embodiments, any carrying case having a handle of sorts, and a means for mobility may be utilized for the luggage support system 100. Suitable materials for the luggage 102 may include, without limitation, leather, a rigid polymer, aluminum, a metal alloy, wood, and fiberglass.

Figure 2A:
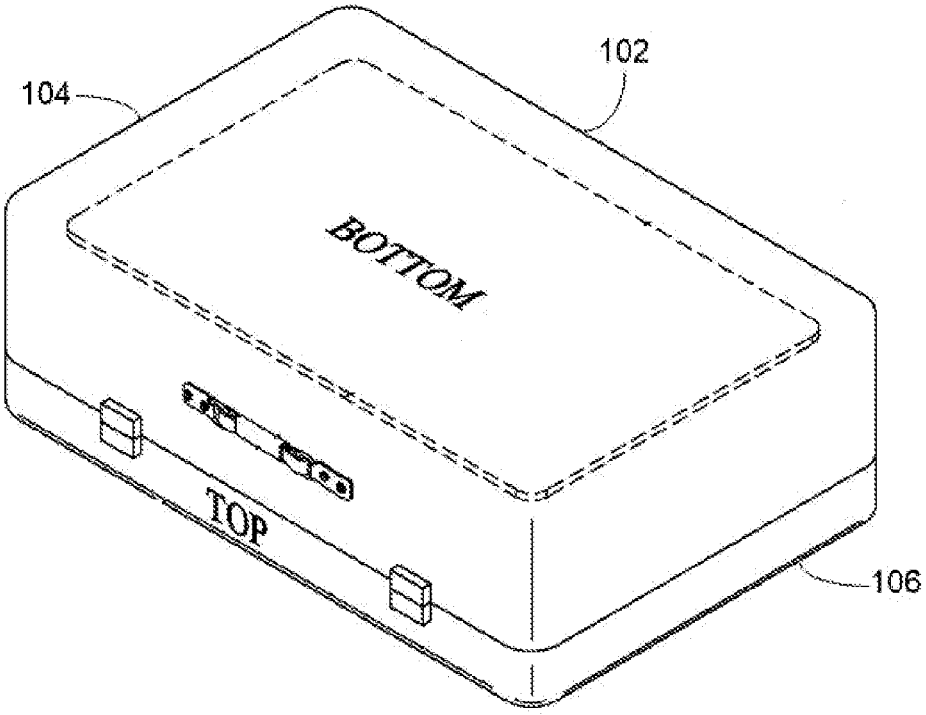
FIGS. 2A and 2B illustrate detailed perspective views of an exemplary luggage support system, where

FIG. 2A shows the luggage 102 having an interior storage section 112 configured to contain at least one item. The interior storage section 112 may include at least one compartment enclosed by an outer surface of the luggage 102. The interior storage section 112 may further include pockets and segregated compartments in the luggage 102.

Figure 2B:
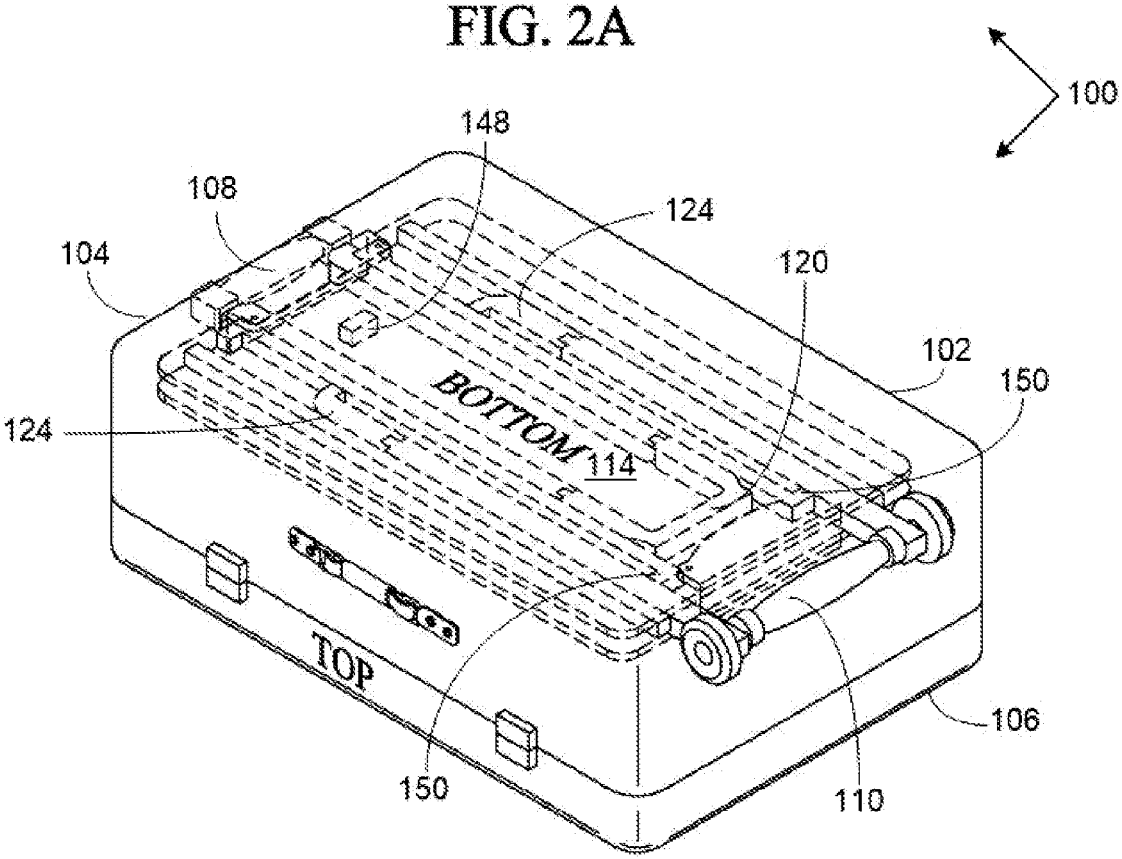

FIG. 2B illustrates the luggage 102 comprising an interior conversion section 114 configured to at least partially convert the luggage 102 between a luggage position 130 and a support position 132. The interior conversion section 114 comprises a frame with railings that form channels. The channels enable the interior conversion section 114 to slidably receive components of the handle portion 108 and the mobile portion 110. A barrier 116 separates the interior conversion section 114 from the interior storage section 112.

In some embodiments, the interior conversion section 114 may include a handle channel 126 and a pair of mobile channels 128. Both the handle and mobile channels 126, 128 are fixed and extends along a longitudinal axis of the luggage 102. Both channels 126, 128 are configured to enable a handle leg 120 and a mobile leg 124 to slidably engage the respective channel 126, 128 for extending and retracting between the luggage position 130 and the support position 132. A handle barrier 148 restricts the handle leg 120 from completely sliding out of the handle channel 126. The handle barrier 148 may form a block that positions on the interior conversion section 114, directly in the path of the handle leg 120 while sliding out of the luggage 102. Similarly, a mobile barrier 150 restricts the mobile leg 124 from completely sliding out of the pair of mobile channels 128. The mobile barrier 150 may form an L-shaped protrusion at the ends of the pair of mobile channels 128.

The interior conversion section 114 comprises a planar, rigid board that forms a surface for the handle leg 120 and the mobile leg 124 to slide upon. The interior conversion section 114 can be used with soft case luggage or luggage 102 that doesn't have a rigid framework for supporting the channels 126, 128. However in some embodiments, such as for a hard shell luggage, the surface is sufficiently rigid to fasten to and support the channels 126, 128, and the interior conversion section 114 is not required. In either case, the handle leg 120 and the mobile leg slidably move in and out of the luggage 102.

In some embodiments, the handle portion 108 positions on an upper end 104 of the luggage 102. The mobile portion 110 positions on a lower end 106 of the luggage 102. The handle portion 108 and the mobile portion 110 are configured to enable gripping and mobility from the luggage position 130. Additionally, the handle portion 108 and the mobile portion 110 are configured to form a pair of substantially parallel support legs 134 for supporting the luggage 102. The support position 132 forms a support stand framework for the luggage 102 to stand. The luggage 102 may also be operable to open and close from the support position 132.

In some embodiments, the handle portion 108 is disposed to position on an upper end 104 of the luggage 102 for lifting, pulling, pushing, opening, and closing the luggage 102. The handle portion 108 includes a grip 118 for enabling transport and manipulation of the luggage 102. The handle portion 108 further comprises a handle leg 120 configured to slidably engage the handle channel 126. It is the extending and retracting movement by the handle leg 120 that at least partially enables conversion between the luggage position 130 and the support position 132.

Turning now to FIGS. 3A-D, the handle leg 120 comprises a handle leg channel end 136 that remains in contact with the handle channel 126. The handle leg channel end 136 is configured to pivot up to 90° on the end of the handle channel 126. In one embodiment, the handle leg channel end 136 includes a first spring biased detent configured to lock the handle portion 108 into the support position 132 after pivoting. However, any number of mechanisms that enable the handle leg 120 to pivot between the support position 132 and the luggage position 130 may be utilized. The handle leg 120 can extend out from the luggage 102 before the movement is restricted by a stop or barrier at a terminal end of the handle leg 120.

In some embodiments, the mobile portion 110 is disposed to position on a lower end 106 of the luggage 102 for facilitating movement of the luggage 102. The mobile portion 110 may include, without limitation, swivelable caster style wheels 122, fixed, in-line skate style wheels 122, or rails. The mobile portion 110 further comprises a mobile leg 124 configured to slidably engage the pair of mobile channels 128. It is the extending and retracting movement by the mobile leg 124 that at least partially enables conversion between the luggage position 130 and the support position 132. The mobile leg 124 can extend out from the luggage 102 before the movement is restricted by a stop or barrier at a terminal end of the mobile leg 124.

Figure 3A:
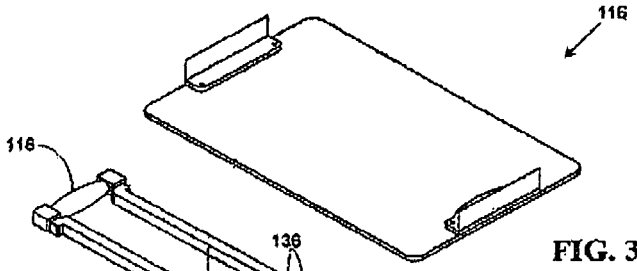
FIGS. 3A-D illustrates a detailed perspective view of an exemplary barrier, handle portion, mobile portion, and interior conversion section, respectively, separated for viewing, in accordance with an embodiment of the present invention.
Figure 3B:
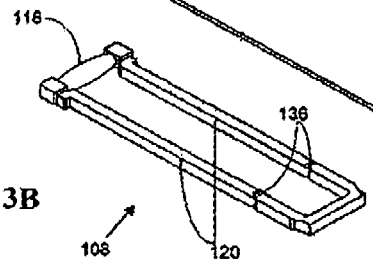
Figure 3C:
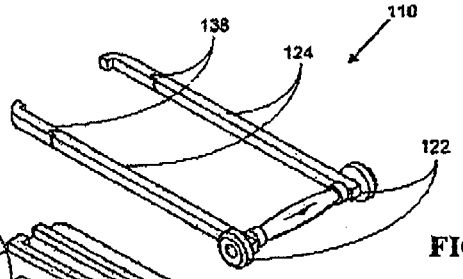
Figure 3D:
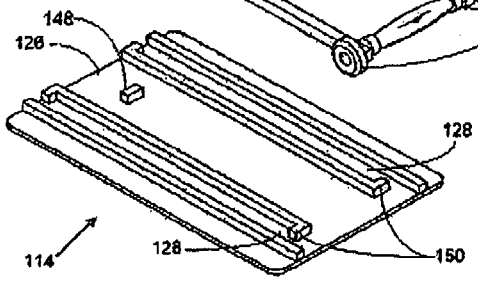

As further referenced in FIG. 3C, the mobile leg 124 comprises a mobile leg channel end 138 that remains in contact with the handle channel 126. The mobile leg channel end 138 is configured to pivot up to 90° on the end of each mobile channel 128. In one embodiment, the mobile leg channel end 138 includes a second spring biased detent configured to lock the mobile portion 110 into the support position 132 after pivoting. However, any number of hinging mechanisms that enable the mobile leg 124 to pivot between the support position 132 and the luggage position 130 may be utilized.

Figure 4A:
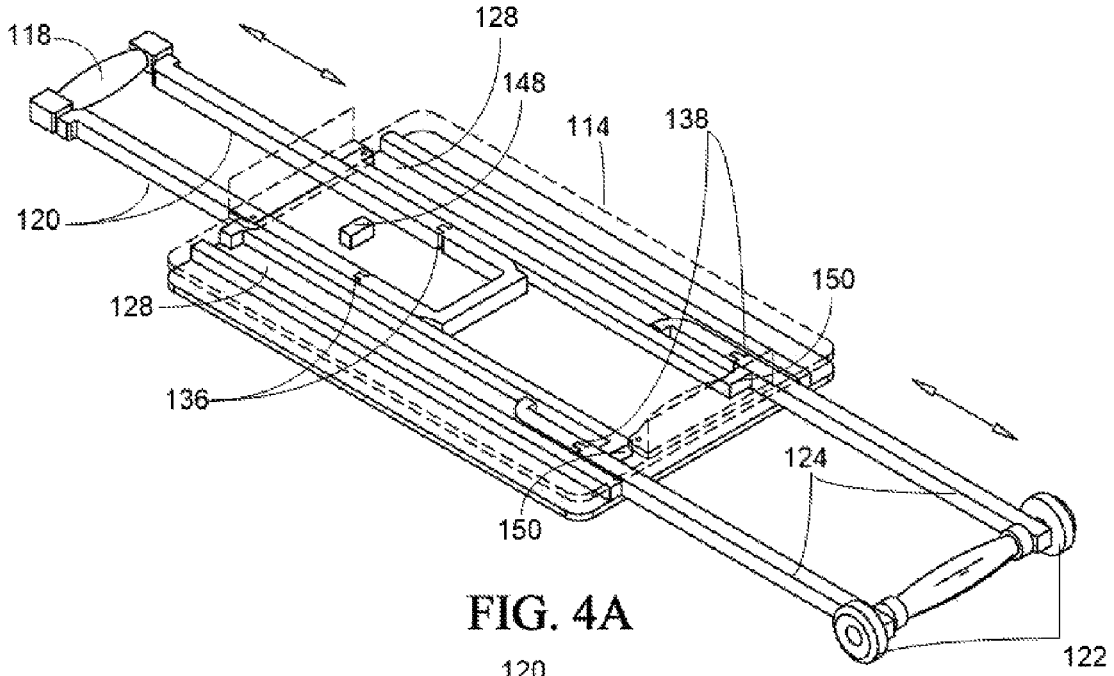
FIGS. 4A and 4B illustrate detailed perspective views of an exemplary interior conversion section slidably engaging a handle leg and a mobile leg, where
Figure 4B:
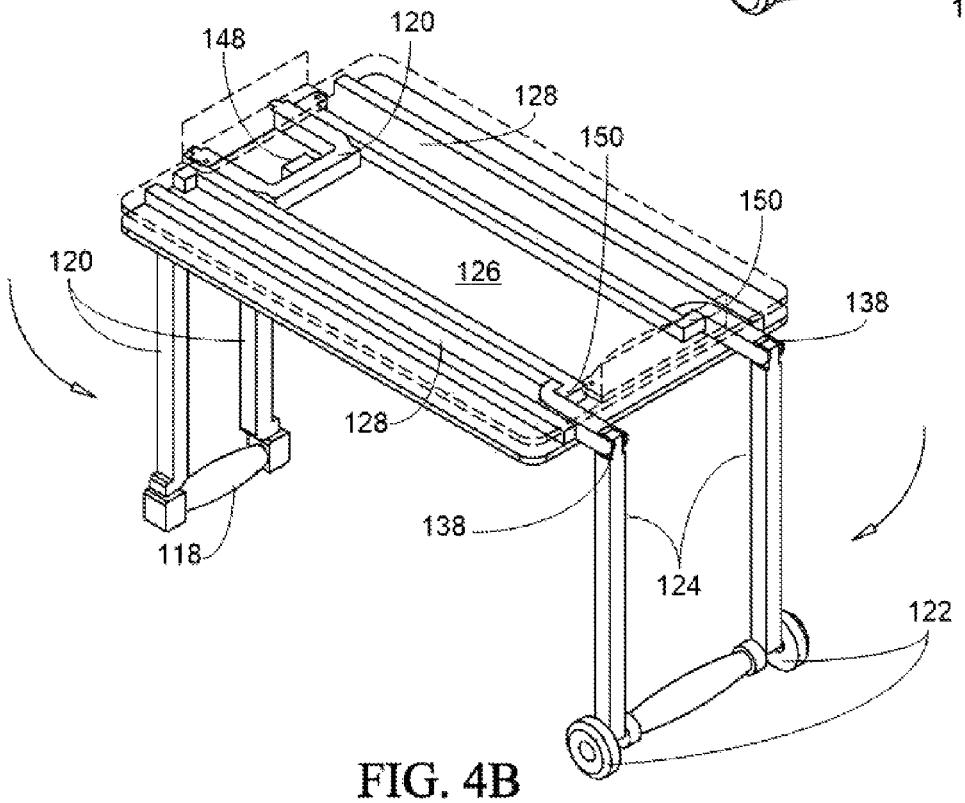

As shown in FIGS. 4A and 4B, the luggage position 130 forms when the handle leg 120 and the mobile leg 124 are fully retracted into the interior conversion section 114 of the luggage 102. The support position 132 is attained when the handle leg 120 and the mobile leg 124 are fully extended from the interior conversion section 114, and pivoted up to 90° in a first direction relative to the luggage 102.

The interior conversion section 114 comprises the mechanisms for converting between the luggage position 130 and the support position 132. The handle leg 120 and the mobile leg 124 extend and retract from the interior conversion section 114. The interior conversion section 114 includes a handle channel 126 for the handle leg 120 to slidably engage. Likewise, the mobile leg 124 slidably engages a pair of mobile channels 128 in the interior conversion section 114. Each channel 126, 128 is fixed, with each leg 120, 124 moving relative to the respective channel 126, 128. Each leg 120, 124 moves through a separate channel 126, 128. The handle channel 126 aligns at the same elevation as the pair of mobile channels 128.

In some embodiments, the handle leg 120 and the mobile leg 124 generally pivot inwardly towards one another, and have substantially the same length while forming the support position 132. In this manner, the luggage 102 remains on a relatively even keel from atop the pair of support legs 134.

Figure 5:
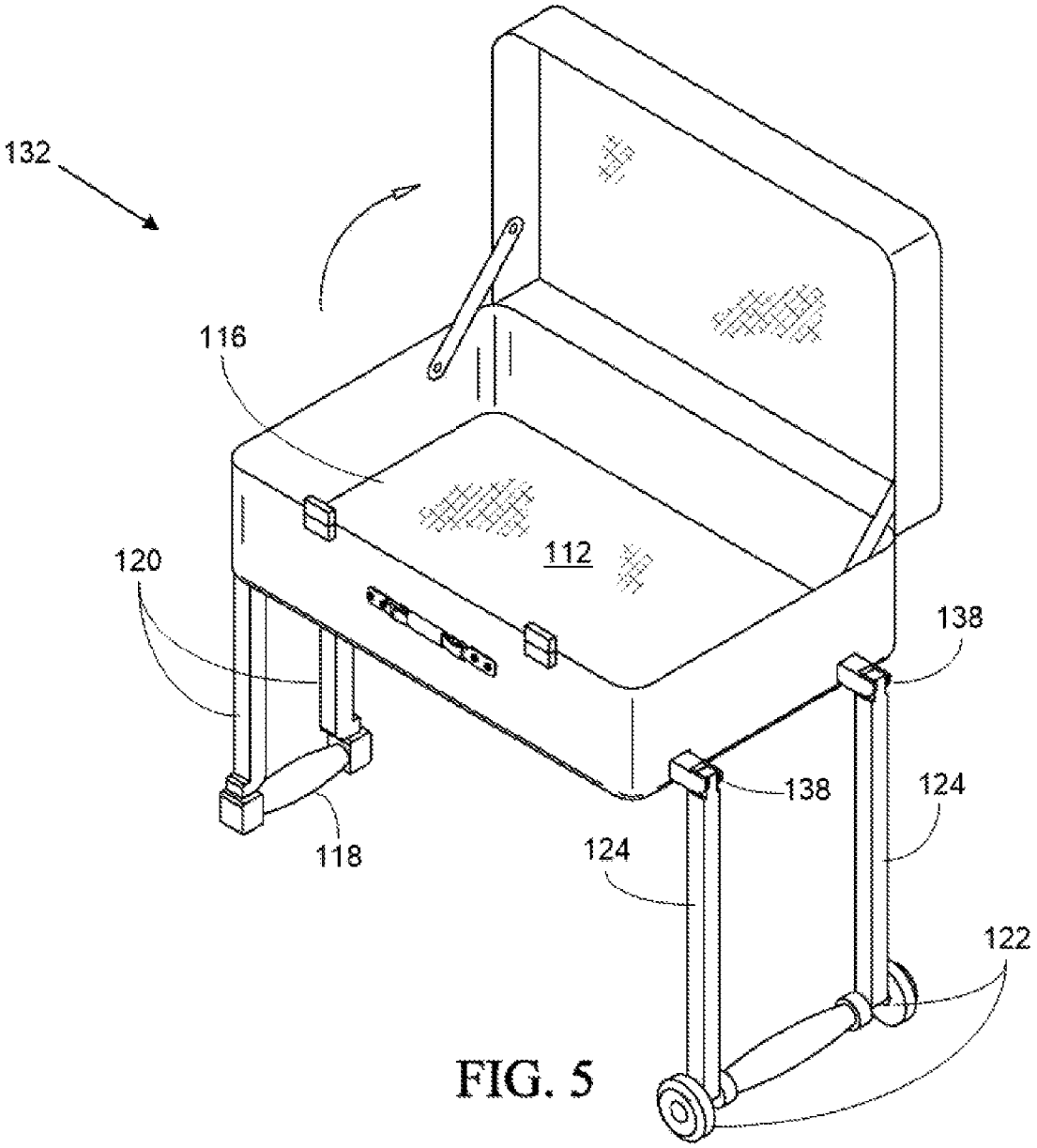
FIG. 5 illustrates a detailed perspective view of an exemplary luggage in a support position, in accordance with an embodiment of the present invention.

FIG. 5 illustrates the luggage 102 with the pair of support legs 134 fully extended to the support position 132. The luggage 102 can open and close to contain items from the support position 132. For returning the luggage 102 back to the luggage position 130, the luggage 102 is lifted to relieve weight off the pair of support legs 134, and the pair of support legs 134 are rotated to a linear configuration and slide back into the interior conversion section 114 on the channels 126, 128. In some embodiments, the top of the interior conversion section 114 forms the bather 116, or support surface, for containing items in the interior storage section 112. Items, such as clothes, hygiene, and tools can be placed on top of the barrier 116, with the operation of the support legs 134 simultaneously occurring.

FIGS. 6A, 6B, 6C, and 6D show the mechanism that enables the handle leg channel end 136 and the mobile leg channel end 138 to rotatably hinge between the support position 132 and the luggage position 130. In one embodiment, the hinge mechanism includes a pair of center pivoting axle holes 144 configured to enable a pivot rod 143 to pass through. The handle leg channel end 136 and the mobile leg channel end 138 can then rotate between the luggage position 130 and the support position 132, using the pivot rod 143 as a fulcrum. However in other embodiments, a ratchet that rotates on a plurality of teeth can be used to support the pivoting motion. The handle leg channel end 136 and the mobile leg channel end 138 are configured to lock between the generally linear luggage position 130, and the substantially 90° angle configuration of the support position 132. As referenced in FIGS. 6C and 60, a spring loaded linear plunger 145 locks the handle leg channel end 136 and the mobile leg channel end 138 into either position by selectively moving between a support lock hole 146 and a luggage lock hole 147.

Figure 6A:
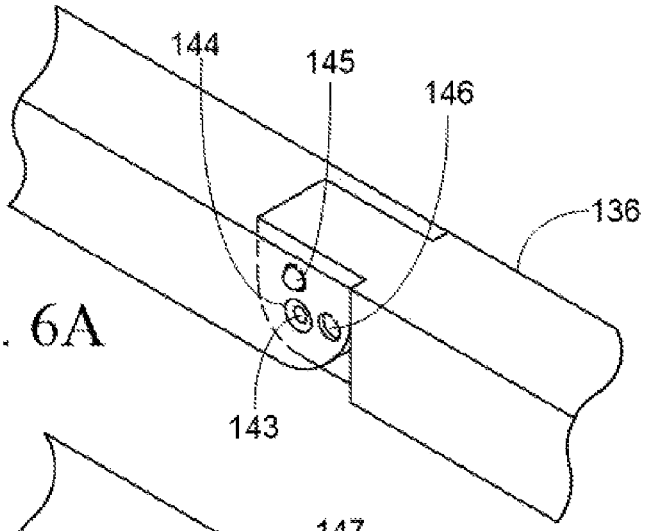
FIGS. 6A, 6B, 6C, and 6D illustrate an exemplary handle leg channel end and mobile leg channel end rotating to an exemplary extended hinge and support hinge, where
Figure 6B:
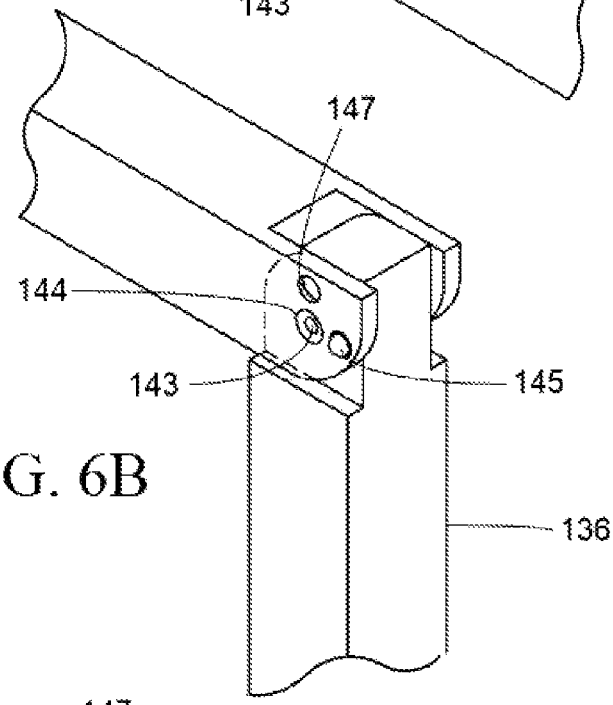
Figure 6C:
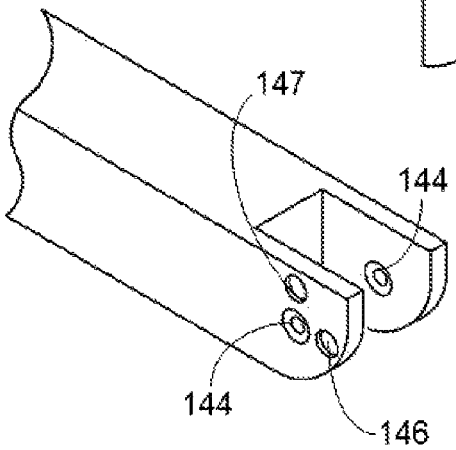
Figure 6D:
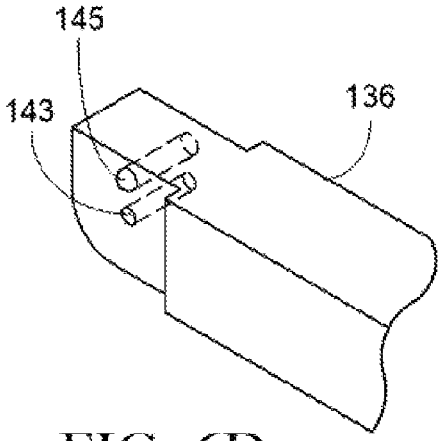

Turning now to FIGS. 6A and 6B, the handle leg channel end 136 and the mobile leg channel end 138 are configured to lock into the luggage position 130, which is the linear configuration, through a spring loaded linear plunger 145 that selectively passes through a luggage lock hole 147. The linear plunger 145 is biased to pass through the luggage lock hole 147 for retaining the handle leg channel end 136 and the mobile leg channel end 138 into the luggage position 130. Depressing one end of the linear plunger 145 releases the channels ends 136, 138 to pivotally release from the luggage position 130 and move to the support position 132.

Conversely, the handle leg channel end 136 and the mobile leg channel end 138 are configured to lock into the support position 132, which is the substantially 90° angle, through the spring loaded linear plunger 145 that selectively passes through a support lock hole 146. The linear plunger 145 is biased to pass through the support lock hole 146 for retaining the handle leg channel end 136 and the mobile leg channel end 138 into the support position 132. Depressing one end of the linear plunger 145 releases the channels ends 136, 138 to pivotally release from the support position 132 and move back to the luggage position 130.

In one alternative embodiment, the handle leg 120 and the mobile leg 124 detach completely from the luggage 102. The detached legs may then threadably engage the lower corners of the luggage 102 to erect the pair of support legs 134 for the support position 132. In yet another alternative embodiment, the grip 118 utilizes retractable wheels 122 that enable mobility from the support position 132. In this manner, the grip 118 and the pair of wheels 122 on the mobile portion 110 work together to provide mobility from the support position 132. In yet another alternative embodiment, the luggage 102 includes a strap to fasten additional baggage, suitcases, and carry-on bags atop the luggage 102 from the support position 132. However, weight preconditions may be required prior to loading objects on the luggage 102.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What we claim is:

1. A luggage support system for converting a luggage into a luggage support, the luggage support system comprising:

a luggage comprising an interior storage section configured to contain at least one item;

the luggage further comprising an interior conversion section configured to at least partially convert the luggage between a luggage position and a support position, the interior conversion section comprising a handle channel and a pair of mobile channels;

a handle extension disposed to position on an upper end of the luggage, the handle extension comprising a handle leg configured to slidably engage the handle channel between the luggage position and the support position, the luggage position comprising the handle leg fully retracted into the interior conversion section, the support position comprising the handle leg fully extended from the interior conversion section, and pivoted up to 90 degrees in a first direction relative to the luggage; and a wheel extension disposed to position on a lower end of the luggage, the wheel extension comprising a mobile leg configured to slidably engage the pair of mobile channels between the luggage position and the support position, the luggage position further comprising the mobile leg fully retracted into the interior conversion section, the support position further comprising the mobile leg fully extended from the interior conversion section, and pivoted up to 90 degrees in the first direction relative to the luggage, wherein the handle extension and the wheel extension are configured to support the luggage and at least one object in the support position, wherein the handle-extension and the wheel extension are configured to perform a handle function and a mobile function, respectively, in the luggage position;

wherein the wheel extension comprises at least two wheels configured to enable mobility by the luggage from the luggage position;

wherein between the at least two wheels is a wheel handgrip configured to be gripped by a hand; wherein the wheel handgrip is a part of the wheel extension and a handle is a part of the handle extension; wherein the wheel extension is comprised of the wheel handgrip, the at least two wheels and the mobile leg; wherein the handle extension is comprised of the handle and the handle leg; wherein the wheel extension and the handle extension are oppositely disposed on the luggage and configured to extend along a longitudinal axis of the luggage in opposite directions; and wherein a handle leg channel end and a mobile leg channel end include a plurality of hinging mechanisms configured to hinge between an extended hinge and a support hinge;

wherein each hinging mechanism of the plurality of hinging mechanisms is configured to lock into the support position with a linear plunger configured to move between support lock hole and a luggage lock hole, the linear plunger biased to pass through a detent hole.

2. The system of claim 1, in which the luggage comprises a spinner or caster luggage.

3. The system of claim 1, in which the system comprises a barrier, the bather configured to separate the interior storage section from the interior conversion section.

4. The system of claim 1, in which the handle comprises a substantially U-shaped grip configured to enable gripping and manipulation of the luggage from the luggage position, the grip further configured to form a first support base from the support position.

5. The system of claim 1, wherein the handle leg channel end is fixed in the handle channel so that the handle leg is configured to pivot up to 90 degrees from the handle channel.

6. The system of claim 1, wherein the mobile leg channel end is fixed in the pair of mobile channels so that the mobile leg is configured to pivot up to 90 degrees en from the pair of mobile channels.

7. The system of claim 1, wherein each hinging mechanism of the plurality of hinging mechanisms is configured to hinge between an extended hinge and a support hinge, the hinging mechanisms comprising a pair of center pivoting axle holes configured to receive a pivot rod for enabling pivoting between the luggage position and the support position.

8. The system of claim 1, in which the handle leg and the mobile leg are substantially the same length.

9. The system of claim 1, wherein each hinging mechanism includes a pair of center pivoting axle holes configured to enable a pivot rod to pass through.

* * * * *